United States Patent [19]

Kovalchek

[11] Patent Number: 4,712,797

[45] Date of Patent: Dec. 15, 1987

[54] GOLF PUTTER WITH SIGHTING DEVICE

[75] Inventor: John G. Kovalchek, Clearwater, Fla.

[73] Assignee: Fore-Sight Golf, Inc., Clearwater, Fla.

[21] Appl. No.: 941,665

[22] Filed: Dec. 15, 1986

[51] Int. Cl.[4] ..... A63B 53/04; A63B 69/36

[52] U.S. Cl. ..... 273/163 R; 273/80 C

[58] Field of Search ..... 273/183 A, 183 E, 162 E, 273/163 R, 164, 193 R, 194 R, 194 A

[56] References Cited

U.S. PATENT DOCUMENTS 3,698,093 10/1972 Marshall ..... 273/163 R 3,826,502 7/1974 Sorge ..... 273/183 E 4,306,721 12/1981 Doyle ..... 273/163 R

*Primary Examiner*—George J. Marlo

*Attorney, Agent, or Firm*—Herbert W. Larson; Joseph C. Mason, Jr.

[57] ABSTRACT

A continuous-length, high-strength wire is formed to enclose a space above a golf ball adjacent the front face of a golf putter. The wire is further formed to provide a pair of legs at right angles to the enclosed space and these legs are permanently mounted in a pair of corresponding holes in a top surface mounting ridge on the golf putter.

8 Claims, 7 Drawing Figures

GOLF PUTTER WITH SIGHTING DEVICE

BACKGROUND OF THE INVENTION

1. Field of the Invention

This invention relates to golf putters. More particularly, it refers to a sighting device mounted over the front face of a golf putter.

2. Description of the Prior Art

The bane of the golf professional and weekend "duffers" is the putting stroke. The number of different putting strokes is only exceeded by the variety of putters employed by golfers. These putters have a variety of features which have been added to the standard blade type putter to try to improve accuracy of the putt. One added feature on many putters is a sighting device.

Sighting devices are described in U.S. Pat. Nos. 3,292,928; 3,529,830, and 3,698,093 together with U.S. Pat. No. Des. 188,677. Unfortunately, the single bar sight shown in these references can be easily misaligned on a golf ball and the resultant putt is errantly directed.

U.S. Pat. Nos. 2,503,506; 3,667,761; 3,866,922; 3,917,277; 4,291,883, 4,527,799; and U.S. Pat. No. Des. 150,497; describe various devices on the back surface of a golf putter to assist alignment. These devices require the golfer's eye to move from back to front over the putter head. This also causes errantly directed putts.

U.S. Pat. Nos. 2,670,209; 4,002,343, and 4,306,721 describe adjustable devices that align over the golf ball on the front face of the putter. Unfortunately devices of this type can come loose or can be improperly mounted by the golfer resulting in improper alignment of the ball. A sighting device is needed which will provide for precise alignment of a golf ball along the preferred line of roll. Such a device needs to be permanently mounted on the putter to prevent improper mounting by the golfer.

SUMMARY OF THE INVENTION

I have discovered a sighting device for a golf putter that is not subject to the problems of the prior art and assists the golfer in lining up his sight to determining the correct position on the golf putter face to stroke the ball. My device is formed from a continuous length of high tensile strength rust resistant wire. The wire is formed to present a shaped space above the golf ball with a point of the wire distal from the front surface of the putter. The wire is further formed to present a pair of legs at right angles to the plane of the shaped space and the legs are imbedded in a corresponding pair of holes in a top mounting ridge on the putter. My device allows the golfer to use the sighting device to determine the correct line of sight along the putting surface and find the exact position on the putter to stroke the ball.

DESCRIPTION OF THE DRAWINGS

The present invention may be best understood by those having ordinary skill in the art by reference to the following detailed description when considered in conjunction with the accompanying drawings in which.

DESCRIPTION OF THE PREFERRED EMBODIMENT

Figure 7:
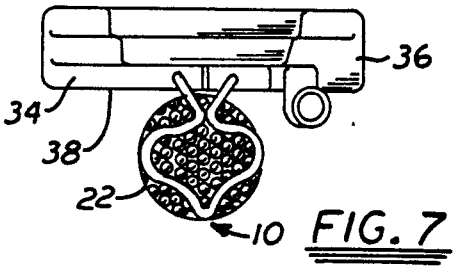
FIG. 7 is a plan view of a putter head with sighting device located over a golf ball.
Figure 1:
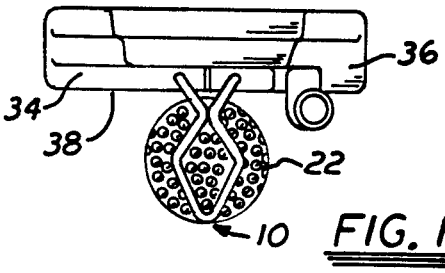
FIG. 1 is a plan view of a putter head with the device of this invention mounted in the putter and sighting a golf ball.
Figure 3:
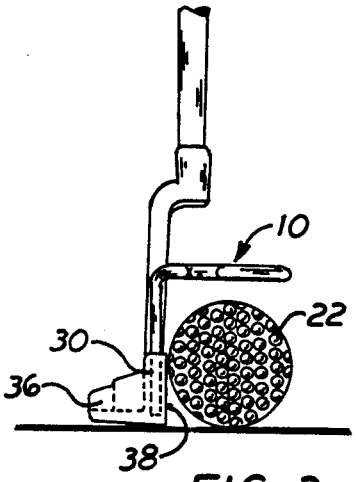
FIG. 3 is a side view in elevation of the putter head, and sighting device over a golf ball.
Figure 2:
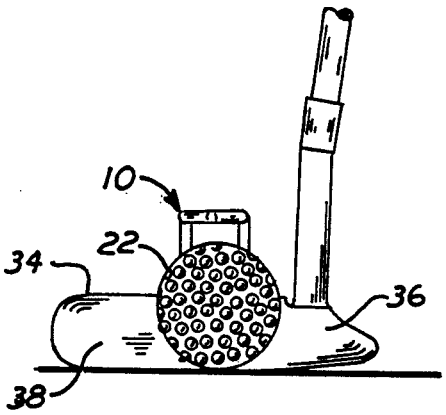
FIG. 2 is a front view in elevation of the putter head, and sighting device over a golf ball.
Figure 4:
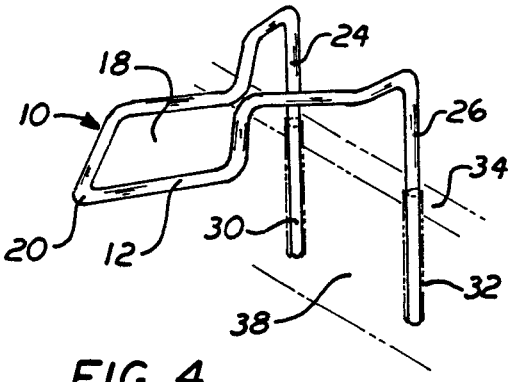
FIG. 4 is a perspective view of the sighting device of this invention.
Figure 5:
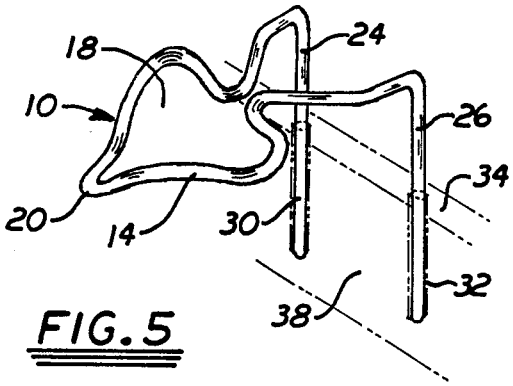
FIG. 5 is a perspective view of an alternate spade shaped sighting device of this invention.
Figure 6:
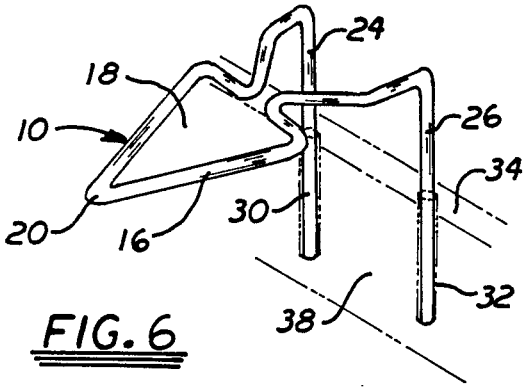
FIG. 6 is a perspective view of another alternate pie-shaped sighting device of this invention.

My sighting device 10 as shown in FIGS. 1 to 6 is made from a continuous-length wire having high a tensile strength and being resistant to rusting. In the alternative it is possible to make the sighting device 10 out of a high strength plastic material and for purposes of this specification wire also includes continuous-length, stiff plastic strand. The sighting device 10 is made by forming the wire into a diamond-shaped 12 configuration or alternatively a spade-shaped 14 or pie-shaped 16 configuration. Each of these configurations enclose a space 18 through which the golfer looks down upon the golf ball 22 as shown in FIG. 1. The diameter of the space can vary but should not exceed the diameter of the golf ball. Each of the spaces 18 end in a point 20 which indicates the direction of the line-of-sight for the ball. The open space 18 above the ball 22 permits the golfer to look down over the ball and properly align it with the front surface of the putter.

The sighting device 10 also has a pair of legs 24 and 26 mounted integral with the putter head 36 through a pair of holes 30 and 32 on a mounting ridge 34 located on the top surface of the putter head 36. The holes 30 and 32 are drilled into mounting ridge 34 on either side of the exact point on the golf putter face 38 which strikes the golf ball 22 for a proper stroke.

The legs 24 and 26 are at right angles to the plane of the diamond 12, spade 14, or pie-shaped 16 configuration. A small amount of epoxy can be placed in holes 30 and 32 in mounting ridge 34 prior to inserting legs 24 and 26 into holes 30 and 32. The epoxy, when hardened, permanently mounts legs 24 and 26 into the club head 36 to make the sighting device 10 integral with the club head 36.

The exact weight and shape of the club head 36 is not critical as long as the face 38 of the club head 36 is flat and presents a surface capable of striking a golf ball. My device can be used on any type club head such as this.

The sighting device can be made from a high-strength aluminum alloy or a galvanized steel of the same type which are frequently used to make nails or other fasteners. As stated above, high-strength plastic materials can be formed to have the same configuration as shown above. However, it is important that the material used be of sufficient strength so that a right angle is maintained between the legs 24 and 26 and the plane of the formed space 12, 14, or 16.

Other shapes of the sighting device can be employed which ar equivalent to the shapes shown in my invention and such shapes do not depart from the scope of my invention.

Having thus described the invention, what is claimed and desired to be secured by Letters Patent is:

1. A sighting device and golf putter in combination comprising (a) a golf putter having a flat front face and a top surface mounting ridge, (b) a continuous length wire made of rust resistant metal or stiff plastic formed to enclose a space above a golf ball juxtaposed to the front face of the putter, and (c) the wire further formed to present a pair of legs at right angles to the plane of the enclosed space and the legs being integral with the putter through their location in a corresponding pair of downward descending holes in the mounting ridge.

2. The sighting device and golf putter according to claim 1 wherein the formed space is spade shaped with a front point distal from the front face of the putter.

3. The sighting device and golf putter according to claim 1 wherein the formed space is diamond shaped with a front point distal from the front face of the putter.

4. The sighting device and golf putter according to claim 1 wherein the formed space is pie-shaped with a front point distal from the front face of the putter.

5. The sighting device and golf putter according to claim 1 wherein the formed space substantially conforms in a lateral direction to the diameter of a golf ball and decreases in diameter to a front point distal from the front face of the putter.

6. The sighting device and golf putter according to claim 1 wherein the wire is an aluminum alloy.

7. The sighting device and golf putter according to claim 1 wherein the wire is galvanized steel.

8. The sighting device and golf putter according to claim 1 wherein the wire is a stiff high-strength plastic.

* * * * *